US008459888B2

(12) United States Patent
Shirotori et al.

(10) Patent No.: US 8,459,888 B2
(45) Date of Patent: Jun. 11, 2013

(54) PAPER CUTTING DEVICE AND PRINTER

(75) Inventors: Motoyoshi Shirotori, Shiojiri (JP); Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 130 days.

(21) Appl. No.: 12/768,219

(22) Filed: Apr. 27, 2010

(65) Prior Publication Data

US 2010/0202819 A1 Aug. 12, 2010

Related U.S. Application Data

(63) Continuation of application No. 11/497,924, filed on Aug. 1, 2006, now Pat. No. 7,731,437.

(30) Foreign Application Priority Data

Aug. 1, 2005 (JP) ..... 2005-222533

(51) Int. Cl.
*B41J 11/00* (2006.01)
*B41J 11/70* (2006.01)

(52) U.S. Cl.
USPC ..... 400/621; 400/691; 400/693; 83/349

(58) Field of Classification Search
USPC ..... 400/621, 621.2, 691, 693, 613; 83/64, 83/349, 624, 679
See application file for complete search history.

(56) References Cited

U.S. PATENT DOCUMENTS

| | | | | |
|---|---|---|---|---|
| 4,244,251 | A | 1/1981 | Iwao et al. | |
| 5,090,285 | A | 2/1992 | Kondo | |
| 5,302,037 | A * | 4/1994 | Schoendienst et al. | 400/586 |
| 5,833,380 | A | 11/1998 | Hosomi et al. | |
| 6,343,884 | B1 | 2/2002 | Watanabe et al. | |
| 6,447,187 | B1 | 9/2002 | Robinson | |
| 6,508,600 | B1 | 1/2003 | Nonaka | |
| 6,807,888 | B1 | 10/2004 | Kiyohara et al. | |
| 6,848,847 | B2 | 2/2005 | Murakoshi et al. | |
| 6,889,585 | B1 | 5/2005 | Harris et al. | |
| 7,267,500 | B2 | 9/2007 | Tsuchiya et al. | |
| 7,563,045 | B2 * | 7/2009 | Nagata | 400/693 |
| 7,625,147 | B2 * | 12/2009 | Sakaino et al. | 400/621 |
| 2002/0069741 | A1 | 6/2002 | Paris | |
| 2003/0156882 | A1 | 8/2003 | Song | |
| 2004/0055435 | A1 | 3/2004 | Hayashi et al. | |

FOREIGN PATENT DOCUMENTS

| | | | |
|---|---|---|---|
| CN | 1159393 | A | 9/1997 |
| DE | 19631494 | A1 | 2/1998 |
| EP | 0775585 | A1 | 5/1997 |
| EP | 1506875 | A2 | 2/2005 |
| JP | 51-095883 | U | 7/1976 |
| JP | 53-142817 | U | 11/1978 |

(Continued)

OTHER PUBLICATIONS

European Search Report Dated Sep. 26, 2006 Re: EP 06 01 4574.

*Primary Examiner* — Matthew G Marini
*Assistant Examiner* — Marissa Ferguson Samreth
(74) *Attorney, Agent, or Firm* — Nutter McClennen & Fish LLP; John J. Penny, Jr.; Christopher Potts

(57) ABSTRACT

A paper cutting device comprising a fixed blade, a movable blade, a movable blade drive mechanism for moving the movable blade, wherein the movable blade and the fixed blade are disposed in substantially perpendicular positions.

8 Claims, 7 Drawing Sheets

FOREIGN PATENT DOCUMENTS

| | | | |
|---|---|---|---|
| JP | 53-142816 | A | 12/1978 |
| JP | 61-177858 | A | 8/1986 |
| JP | 07-015746 | A | 1/1995 |
| JP | 07-137378 | A | 5/1995 |
| JP | 08-309689 | A | 11/1996 |
| JP | 09-038892 | A | 2/1997 |
| JP | 09-254474 | A | 9/1997 |
| JP | 10-000592 | A | 1/1998 |
| JP | 10-315188 | A | 12/1998 |
| JP | 11198469 | A | 7/1999 |
| JP | 11-221791 | A | 8/1999 |
| JP | 2001-121764 | A | 5/2001 |
| JP | 2001341369 | A | 12/2001 |
| JP | 2004-268207 | A | 9/2004 |
| JP | 2004-268208 | A | 9/2004 |

* cited by examiner

PAPER CUTTING DEVICE AND PRINTER

RELATED APPLICATIONS

This application is a continuation of U.S. application Ser. No. 11/497,924 filed on Aug. 1, 2006, entitled "PAPER CUTTING DEVICE AND PRINTER." The teachings of the aforementioned application are incorporated herein by reference.

BACKGROUND OF THE INVENTION

1. Field of Technology

The present invention relates to a paper cutting device for cutting printed recording paper, and to a printer in which this paper cutting device is incorporated.

2. Description of Related Art

Printers that print to a long tape of recording paper wound into a roll on a core (that is, roll paper) commonly have a paper cutting device disposed near the paper exit for cutting the paper to a certain length after the paper is printed. One type of such paper cutting device is a scissors-like device comprising a fixed blade and a movable blade. Japanese Unexamined Patent Appl. Pub. H8-309689 teaches a scissor-type paper cutting device, and Japanese Unexamined Patent Appl. Pub. H9-254474 teaches a printer comprising a scissor-type paper cutting device.

The paper cutting device of the printer taught in Japanese Unexamined Patent Appl. Pub. H9-254474 has the fixed blade mounted on an operable cover that opens and closes the storage compartment where the roll paper is held, and disposes the movable blade on the printer chassis side. When the operable cover opens, the fixed blade separates from the movable blade and thus opens the paper path from the roll paper compartment past the printing position and paper cutting position to the paper exit. As a result, the roll paper can be easily replaced. When the operable cover then closes, the movable blade and fixed blade are positioned so that the paper can be cut.

In a scissor-type paper cutting device the fixed blade and movable blade are disposed in opposing positions either vertically or longitudinally (in the front-to-back direction) to the printer, and are supported so that the cutting edges touch at a point. The movable blade is driven to pivot from the side of the paper at which cutting starts, and the paper is cut at the position of the paper between the blades by gradually moving the point of contact between the two blades from the paper edge where cutting starts (the side where the movable blade pivots) to the edge where cutting ends (the distal end of the blade).

SUMMARY OF THE INVENTION

Problem to be Solved

The fixed blade and movable blade are both substantially flat knives. A scissor-type paper cutting device cuts by driving these knives to intersect while overlapping through the thickness of the blades like regular scissors. As a result, a scissor-type paper cutting device must have enough space to house both of these blades in either the vertical or the longitudinal direction of the printer, that is, the direction in which the fixed blade and movable blade oppose each other. Space is also needed for the movable blade to pivot in either the vertical or the longitudinal direction of the printer. This space must be provided in either the vertical or longitudinal direction of the printer, and therefore limits where the paper cutting device can be located in the printer. As a result, there is limited freedom positioning a scissor-type paper cutting device in the printer, and increasing the size of the printer is unavoidable.

More particularly, if the paper exit faces the front or the back at the top of the printer, the printed paper will be discharged from the front or the back. The fixed blade and movable blade must therefore be disposed in opposition vertically to the paper exit in order to cut the paper, and incorporating this type of paper cutting device increases the height of the printer.

When the printer is used for printing receipts and is installed on a low shelf below the counter in a fast food restaurant, for example, the printer must be short. In addition, the paper exit must be disposed facing forward at the top part of the printer so that the operator can easily remove the printed paper from the front of the printer. Satisfying these needs is not possible by using of the prior art, however.

An object of the present invention is therefore to provide a scissor-type paper cutting device that is compact and affords freedom in positioning the paper cutting device.

A further object of the invention is to provide a printer in which a scissor-type paper cutting device is incorporated without increasing the printer dimensions.

To achieve these objects, a paper cutting device according to the present invention comprises a fixed blade, a movable blade, and a movable blade drive mechanism for moving the movable blade, and the movable blade and the fixed blade are disposed in substantially perpendicular positions.

By placing the fixed blade and movable blade substantially perpendicularly, one blade can be disposed substantially horizontally and the other can be disposed substantially vertically. Compared with a conventional arrangement in which both blades are disposed in parallel planes, i.e., in opposition vertically or longitudinally (that is, in the front-to-back direction), there is greater freedom in positioning the blades. More specifically, the blades can be easily located without wasting space when both blades are assembled into a printer. A compact, space-efficient paper cutting device can therefore be provided.

In this paper cutting device the movable blade and the fixed blade touch at the end where paper cutting starts; and the movable blade drive mechanism causes the movable blade to pivot on the end portion at the side where paper cutting starts so that the contact position between the fixed blade and the movable blade moves from the end where paper cutting starts to the end where paper cutting ends.

In a conventional scissor-type paper cutting device the fixed blade and movable blade are disposed side by side overlapping in opposition through the thickness of the blades like a pair of scissors, and touch at a point on the end where cutting starts. When cutting paper, the point of contact between the blades moves from the end where cutting starts to the end where cutting ends. In order to cut reliably with this arrangement, the fixed blade and movable blade must contact at a point. To achieve this, both blades must have a slight curvature overall in order to easily assure contact at a point. This is the same with regular scissors.

This invention, however, pushes both blades together from substantially perpendicular directions to contact at a point. As a result, a flat fixed blade and a flat movable blade can be used and made to contact at a point at a suitable contact angle to cut the paper. The manufacturing cost can therefore be reduced because a step to impart curvature to both blades is not needed. Precise positioning is also not needed when assembling the blades, and the manufacturing cost can therefore be reduced and the manufacturing quality can be improved.

Further preferably, the fixed blade can move substantially perpendicularly to the movable blade, and is urged by an urging member toward the movable blade. When the movable blade pivots to contact the fixed blade at a point and the fixed blade is completely stationary, the movable blade may strike and bite into the fixed blade as a result of assembly deviations and change over time. This damages both blades, can result in the movable blade locking, and may result in damage to the paper cutting device. To avoid this in the prior art, the shape of the blades must be produced with high precision and the movable blade drive mechanism must drive the movable blade with high precision in order to prevent such problems due to error and aging. When the blades start to collide in the present invention, however, the fixed blade moves substantially perpendicularly to the movable blade and can retract while being returned to the original position by the urging member. The blades can thus be easily prevented from biting, and a smooth paper cutting action can be assured. High precision is also not needed in the movement of both blades, and the manufacturing cost can therefore be reduced.

Yet further preferably, the urging position where the urging member applies force to the fixed blade is offset to a position outside of the end-of-cutting end of the fixed blade. If the urging position of the fixed blade is located between the end where paper cutting starts and the end where paper cutting ends, the paper cutting position of the blades (where the blades contact) shifts from before to after the urging position as the movable blade pivots in contact with the fixed blade, and the angular moment of contact with the fixed blade reverses around the urging position in a seesaw motion. The angular moment of the movable blade to the fixed blade therefore reverses as the paper cutting position passes the urging position, the fixed blade therefore pivots slightly and rocks, and the cutting line shifts. In at least one embodiment of the present invention, however, the direction of the angular moment does not change, this problem therefore does not occur, and the recording paper can be cut in a clean line without interruption.

A printer having a paper cutting device according to this invention has an operable cover unit attached openably and closeably to the printer; and a paper cutting device comprising a fixed blade affixed on the printer chassis side, a movable blade disposed to the operable cover unit side, and a movable blade drive mechanism disposed to the operable cover unit side. The paper cutting device has a fixed blade, a movable blade, and a movable blade drive mechanism for moving the movable blade, with the movable blade and the fixed blade disposed in substantially perpendicular positions.

In the printer according to the present invention the movable blade and the fixed blade touch at the end where paper cutting starts; and the movable blade drive mechanism causes the movable blade to pivot on the end portion at the side where paper cutting starts so that the contact position between the fixed blade and the movable blade moves from the end where paper cutting starts to the end where paper cutting ends.

A printer according to another embodiment of the invention has an operable cover unit attached openably and closeably to the printer; and a paper cutting device comprising a movable blade disposed on the printer chassis side, a fixed blade affixed on the operable cover unit side, and a movable blade drive mechanism disposed to the printer chassis side. The paper cutting device has a fixed blade, a movable blade, and a movable blade drive mechanism for moving the movable blade, with the movable blade and the fixed blade disposed in substantially perpendicular positions.

A paper cutting device having a fixed blade and a movable blade disposed substantially perpendicularly to each other is assembled in the printer according to the present invention. Compared with a paper cutting device having the blades disposed opposite each other, the paper cutting device of this invention affords greater freedom positioning the blades. The blades can therefore be located without wasting space when assembled in the printer, thus affording a small printer. A printer comprising a paper cutting device according to the present invention therefore requires less installation space, and can therefore be installed where space is limited.

In a printer according to the present invention the fixed blade is disposed to either the operable cover unit side or the printer chassis side, and the movable blade and movable blade drive mechanism are disposed to the other side. As a result, opening the operable cover unit opens the path from the roll paper compartment past the printing position and paper cutting position to the paper exit. The roll paper can therefore be easily replaced. Furthermore, closing the operable cover unit places the movable blade and fixed blade at positions where the recording paper can be cut.

The operable cover unit of a printer according to the present invention can pivot on a bottom end part of the operable cover unit from a closed position where the operable cover unit is substantially vertical to an open position where the operable cover unit is open a predetermined angle to the front or to the back of the printer. The movable blade of the paper cutting device is disposed substantially vertically extending widthwise to the printer at a top end portion of the operable cover unit with the cutting edge facing up, and the fixed blade of the paper cutting device is disposed substantially horizontally extending widthwise to the printer at a top end portion on the printer chassis side opposite the top end portion of the operable cover unit.

Because the paper cutting device requires less space vertically, increase in the height of the printer resulting from incorporating the paper cutting device of the present invention can be suppressed and a shorter printer can therefore be provided than with the prior art. Furthermore, the paper exit can be located at the top part of the printer so that the paper can be removed from either the front or the back.

Yet further preferably, the fixed blade can move in a direction substantially perpendicular to the movable blade, and is urged by an urging member toward the movable blade.

The urging position where the urging member applies force to the fixed blade is offset to outside of the end-of-cutting end of the fixed blade.

Yet further preferably, the printer also has a fixed blade retraction mechanism for retracting the fixed blade in a direction away from the movable blade (toward the inside of the printer) in resistance to the urging force of the urging member in conjunction with opening the operable cover unit.

When the operable cover unit is opened in a conventional arrangement the fixed blade attached to the top part of the printer chassis is exposed. By retracting the fixed blade by means of the fixed blade retraction mechanism, the exposed fixed blade can be moved away from contact with the user's fingers.

A printer according to the present invention can also use an arrangement having a fixed blade mounting plate to which the fixed blade is attached, and a pivot plate for supporting the fixed blade mounting plate. The pivot plate is attached to the printer chassis pivotably in the front-to-back direction of the printer around a bottom end portion of the pivot plate, the fixed blade mounting plate is attached at a top portion of the printer rockably in a direction substantially perpendicular to the movable blade, the urging member urges the fixed blade mounting plate, and the fixed blade retraction mechanism comprises an engaging portion affixed to the operable cover unit and an engaged portion attached to the pivot plate rendered so that opening the operable cover unit causes the engaging portion to push the engaged portion, thus causing the pivot plate to unconditionally pivot so that the fixed blade mounting plate attached to a top portion of the pivot plate moves in a direction away from the movable blade.

Opening the operable cover unit thus causes the fixed blade to retract automatically.

A scissor-type paper cutting device according to at least one embodiment of the present invention disposes the fixed blade and movable blade substantially perpendicularly to each other so that the cutting edges meet perpendicularly. Compared with a conventional scissor-type paper cutting device in which both blades are disposed in opposition vertically or the front-to-back direction of the printer and the blades overlap in the thickness direction like regular scissors, there is greater freedom positioning the blades and the paper cutting device can be rendered compactly without wasting space.

Furthermore, because the blades contact substantially perpendicularly, the blades can be disposed to contact at a point with a suitable contact angle without imparting a curve to the fixed blade and movable blade. Both blades can therefore be easily manufactured, the manufacturing cost can be reduced, and manufacturing quality can be improved.

Because the blades can be positioned with a great degree of freedom when assembling this paper cutting device in a printer according to the present invention, the paper cutting device can be rendered efficiently without wasting installation space, and increase in the printer size resulting from incorporating a paper cutting device can be suppressed, thus affording a small printer.

Furthermore, because the fixed blade and movable blade contact from substantially perpendicular directions instead of causing the edges to overlap through the thickness direction as in regular scissors, the blades will not cross, which would prevent the operable cover unit from being opened if the movable blade stops while cutting the paper. The blades can therefore be easily disposed so that the operable cover unit can still be opened even when the movable blade stops while cutting the paper.

Furthermore, because the fixed blade that is affixed to the printer chassis retracts automatically when the operable cover unit opens, accidents caused by the user's finger touching the movable blade when the operable cover unit is open can be prevented.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

Figure 1:
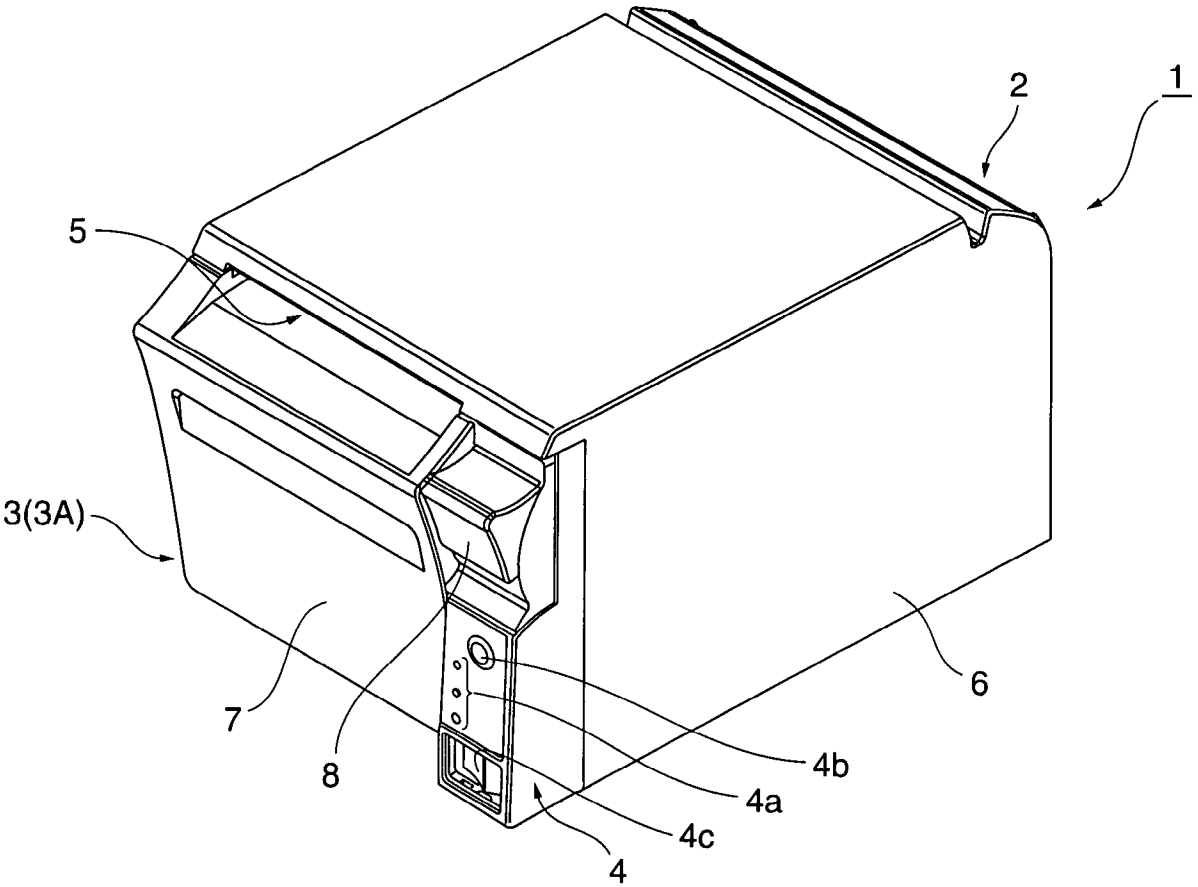
FIG. 1 is an oblique external view showing a printer applying the present invention.
Figure 2:
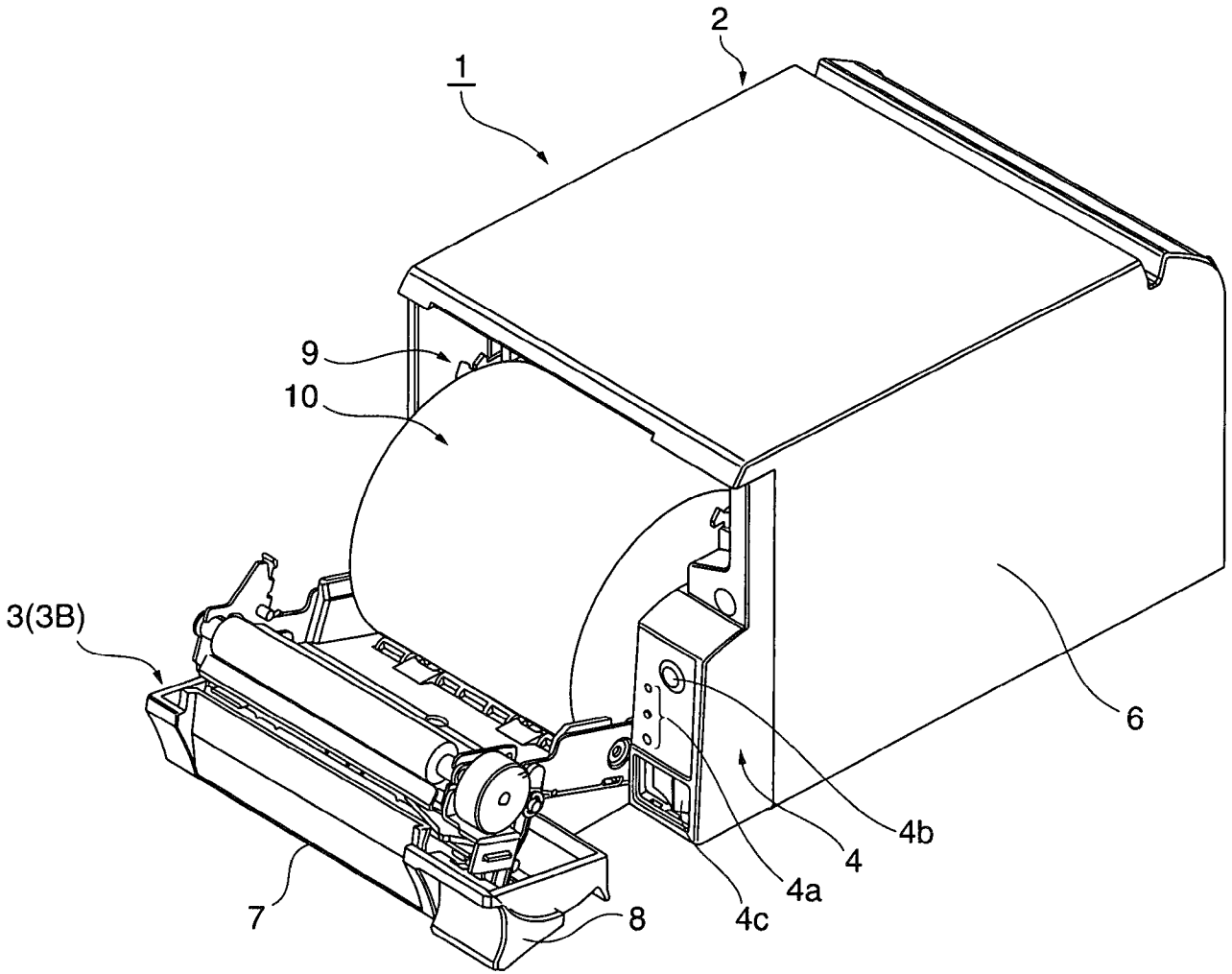
FIG. 2 is an oblique external view showing the printer with the operable cover open.

FIG. 1 is an oblique external view of a thermal printer according to the present invention, and FIG. 2 an is oblique view showing the printer when the operable cover unit is open.

A thermal printer 1 according to this embodiment of the invention has a printer chassis 2 with an operable cover unit 3 attached at the front. An operating panel unit 4 is disposed to a front corner of the printer chassis 2. A paper exit 5 extending widthwise to the printer is formed at the top part of the operable cover unit 3 at the front of the printer.

The printer chassis 2 is covered by a box-like printer case 6 that has a long depth front to back and is open at the front and bottom sides. An operable cover case 7 that defines the printer front is attached at the front of the operable cover unit 3. Operating an operating lever 8 located at the operating panel unit 4 releases a cover lock not shown, thereby releasing and causing the operable cover unit 3 to swing forward and open a predetermined angle pivoting on the bottom end part of the operable cover unit 3. Opening the operable cover unit 3 opens a path from the roll paper compartment 9, passed a printing position determined by the thermal print head 16 and platen roller 15, a paper cutting position determined by the fixed blade 21 and movable blade 22 (see FIG. 3), and to the paper exit 5. This exposes the roll paper compartment 9 formed inside the thermal printer 1, and enables easily replacing the roll paper 10.

A state indicator group 4*a* of LEDs, for example, a feed button 4*b*, and a power switch 9*c* are provided on the front of the operating panel unit 4.

Figure 3:
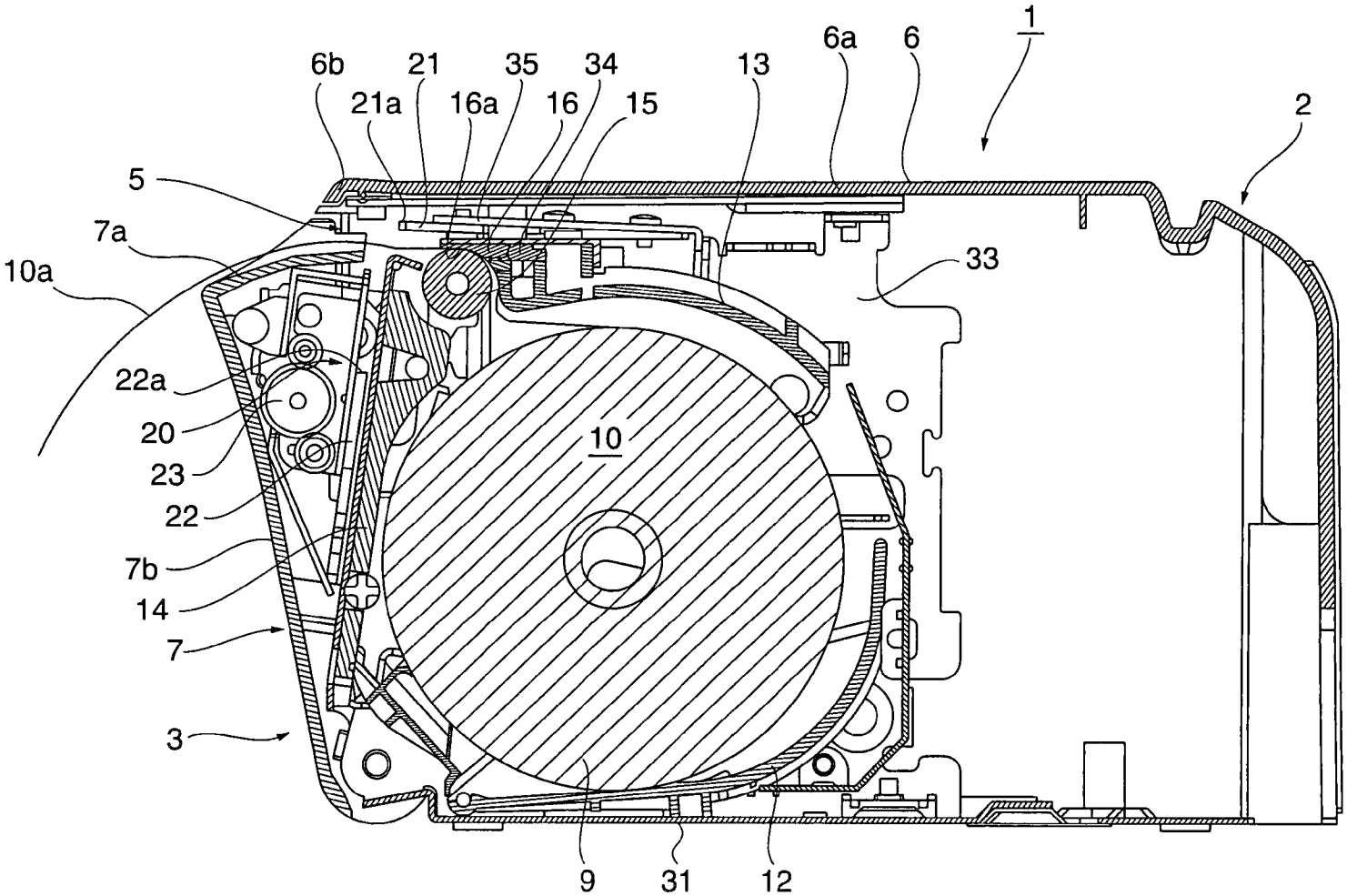
FIG. 3 is a schematic view showing the internal arrangement of the printer.

FIG. 3 is a schematic view of the inside of the thermal printer 1. A roll paper compartment 9 is formed inside the thermal printer 1 surrounded by a curved paper guide bottom 12, paper guide top 13, and paper guide front 14 each extending widthwise to the printer and generally conforming to the shape of the roll paper 10. The roll paper 10 is held so that it can rotate freely inside the roll paper compartment 9, and the tape of recording paper 10*a* that is delivered from the roll paper 10 is pulled to the front past the printing position between the platen roller 15 and thermal print head 16, and is moved to the front of the printer from the paper exit 5 disposed in front of the printing position.

The paper exit 5 is formed between the front edge 6*b* of the case top 6*a* part of the printer case 6 and the curved top portion 7*a* of the operable cover case 7 disposed below front edge 6*b*. A scissor-type paper cutting device 20 is located in front of the paper exit 5.

The paper cutting device 20 has a fixed blade 21 disposed on the printer chassis 2 side, and a movable blade 22 and movable blade drive mechanism 23 disposed on the operable cover unit 3 side. The fixed blade 21 is disposed substantially horizontally widthwise to the printer with the cutting edge 21*a* facing forward. The movable blade 22 is disposed substantially vertically widthwise to the printer with the cutting edge 22*a* facing up at a position substantially directly below the cutting edge 21*a* of the fixed blade 21. When the recording paper 10*a* is conveyed between these cutting edges 21*a* and 22*a* (the paper cutting position), the movable blade 22, which is on the bottom, is pivoted upwards so that the cutting edges 21*a* and 22*a* close together widthwise to the printer and cut the recording paper 10*a* located therebetween.

The paper guide front 14 that is part of the roll paper compartment 9, the platen roller 15, and the movable blade 22 of the paper cutting device 20 are thus disposed to the operable cover unit 3. As a result, when the operable cover unit 3 is opened from the closed position 3A to the open position 3B, the roll paper compartment 9 is opened as shown in FIG. 2, and the paper transportation path is opened from the roll paper compartment 9 to the paper exit 5 past the printing position and the paper cutting position. The roll paper 10 can therefore be easily loaded and set. When the recording paper 10*a* is then pulled out from the roll paper 10 in the roll paper compartment 9 and the operable cover unit 3 is closed, the paper transportation path is completed and the recording paper 10*a* is automatically threaded through the paper transportation path.

Figure 4B:
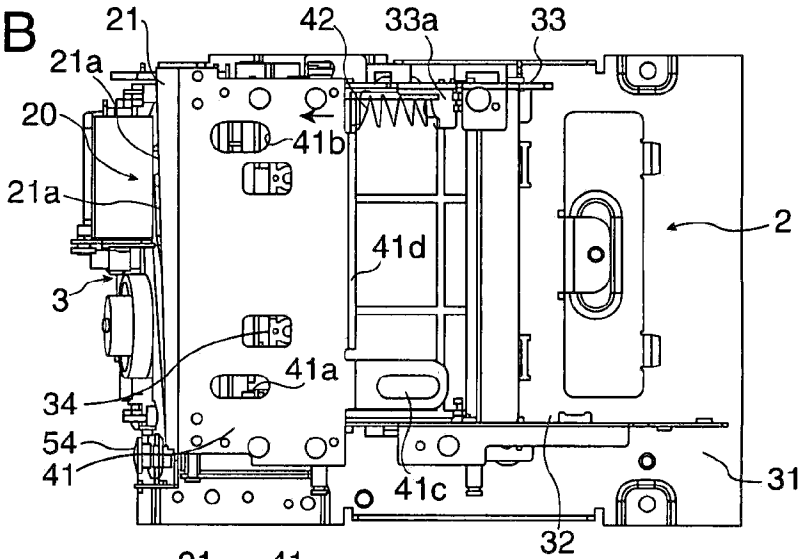
FIG. 4B is a plan view of the printer chassis and operable cover unit of the printer.
Figure 4C:
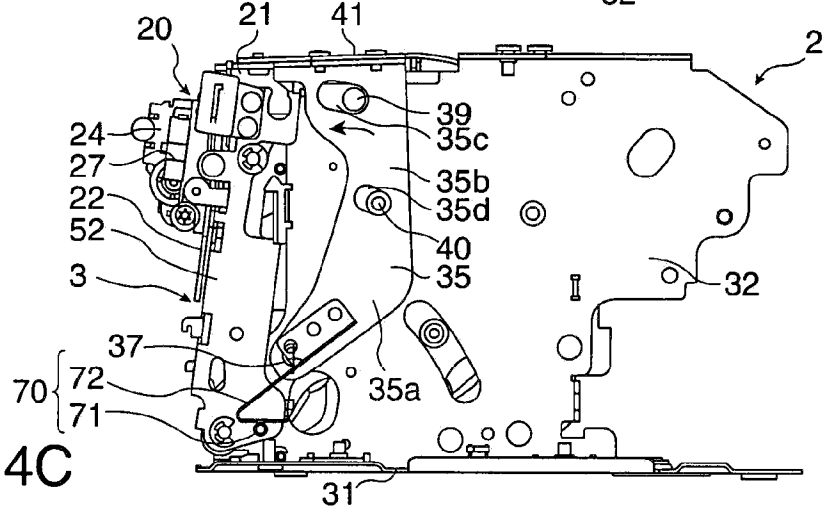
FIG. 4C is a side view of the printer chassis and operable cover unit of the printer.
Figure 4A:
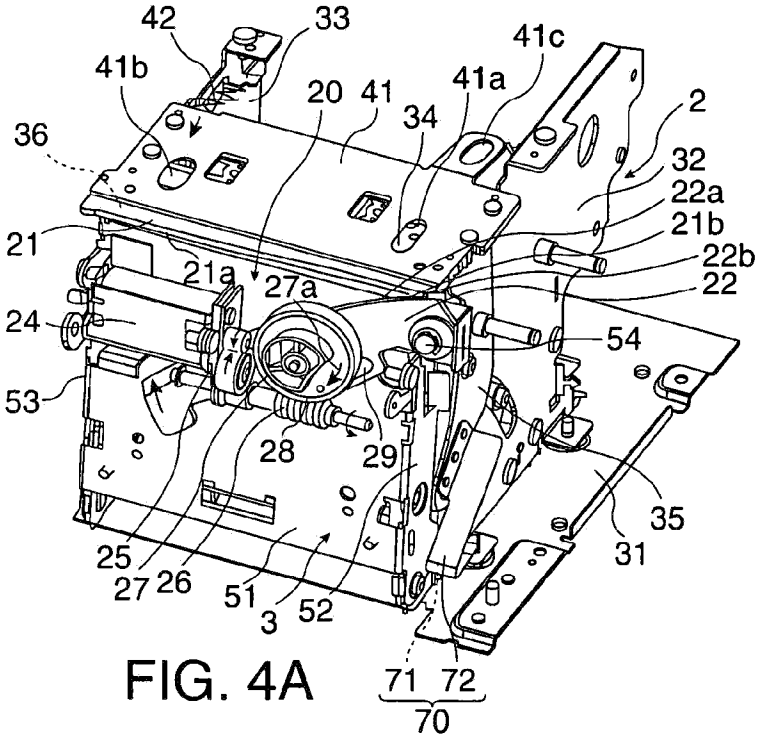
FIG. 4A is an oblique view of the printer chassis and operable cover unit of the printer.

FIG. 4A to FIG. 4C are an oblique view, a plan view, and a side view showing the main parts of the printer chassis 2 and operable cover unit 3 with the printer case 6 and operable cover case 7 removed and the paper cutting device 20 in the position before starting to cut the recording paper 10*a*.

Figure 5B:
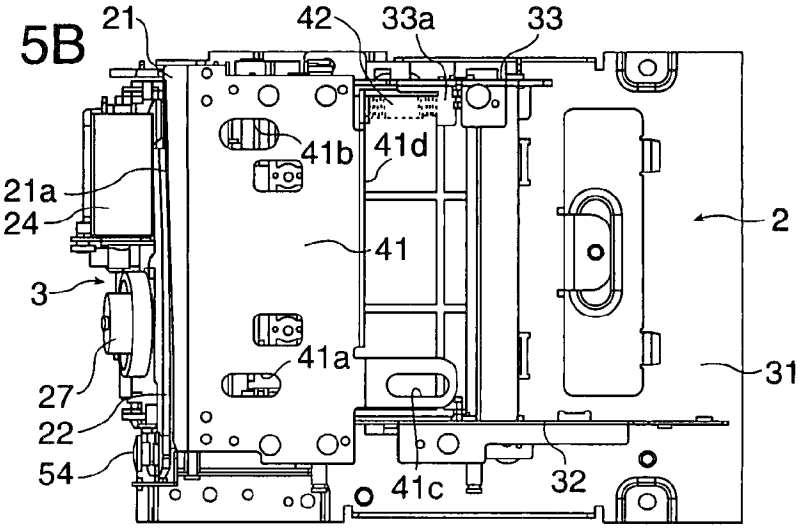
FIG. 5B is a plan view of the paper cutting device of the printer when the paper is partially cut.
Figure 5C:
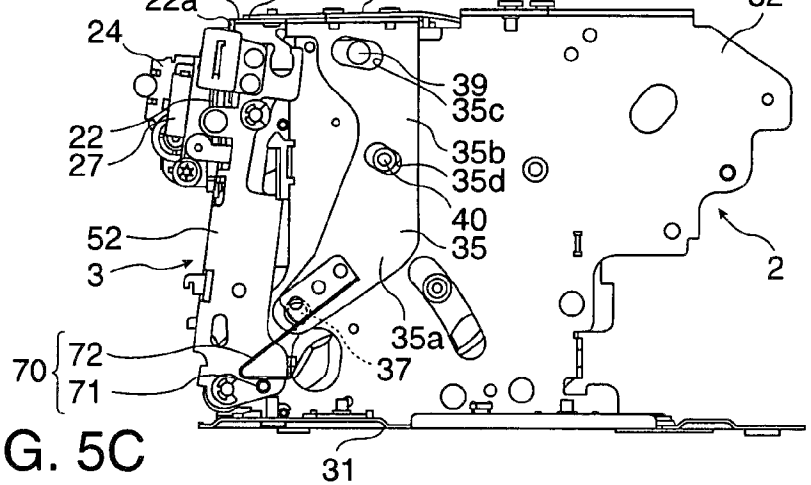
FIG. 5C is a side view of the paper cutting device of the printer when the paper is partially cut.
Figure 5A:
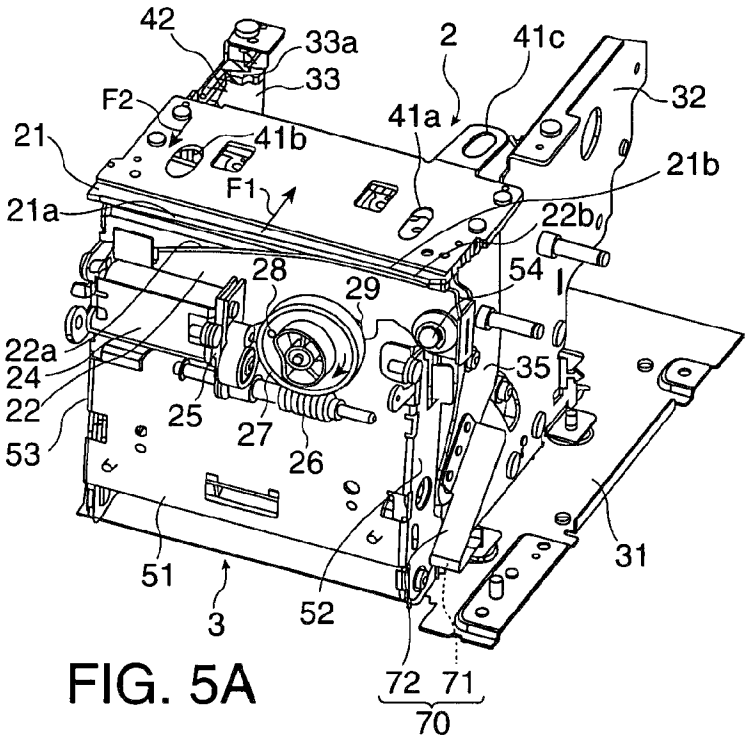
FIG. 5A is an oblique view of the paper cutting device of the printer when the paper is partially cut.
Figure 6B:
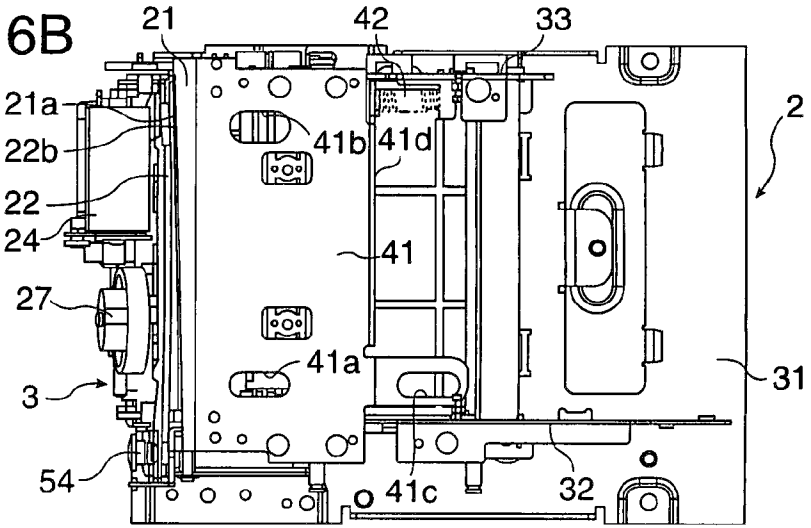
FIG. 6B is a plan view of the paper cutting device of the printer when paper cutting is finished.
Figure 6C:
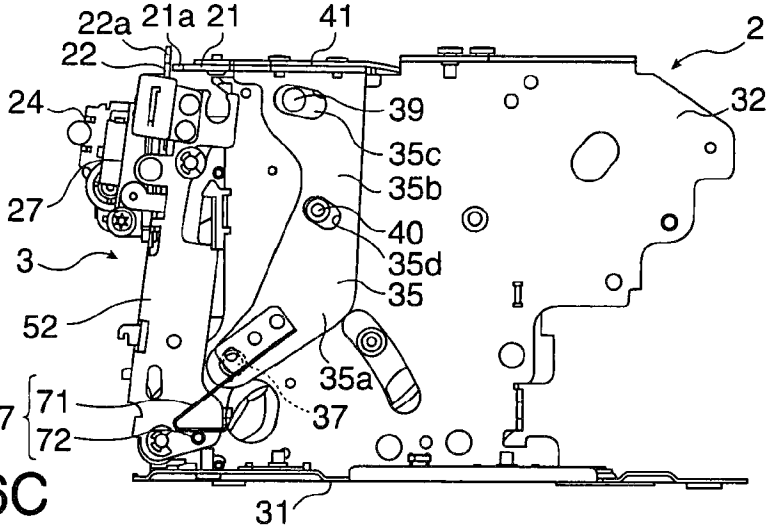
FIG. 6C is an oblique view of the paper cutting device of the printer when paper cutting is finished.
Figure 6A:
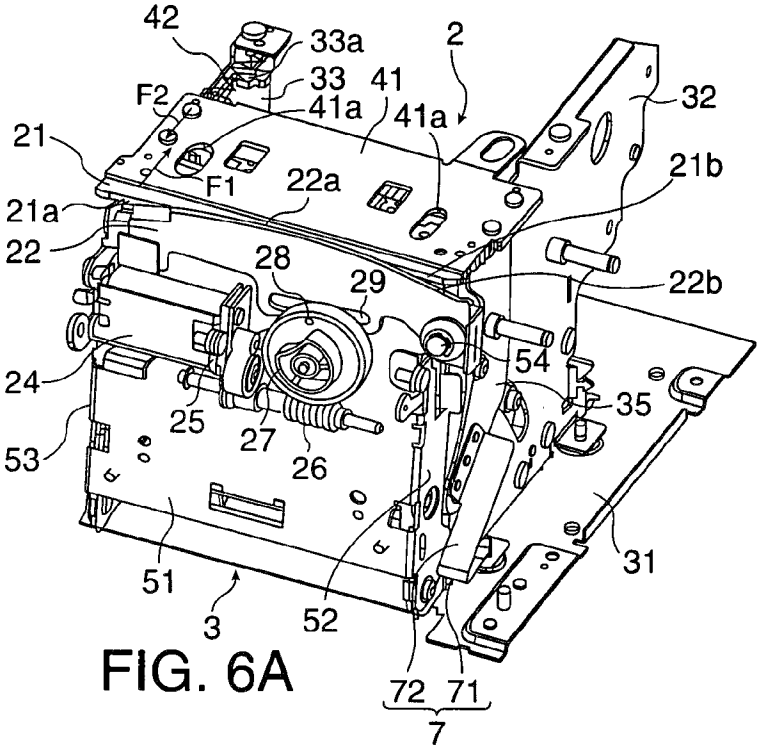
FIG. 6A is an oblique view of the paper cutting device of the printer when paper cutting is finished.

FIG. 5A to FIG. 5C are a similar oblique view, plan view, and side view when the paper cutting device 20 has partially cut the recording paper 10*a*, and FIG. 6A to FIG. 6C are a similar oblique view, plan view, and side view when cutting is finished.

The paper cutting device is described below referring to these figures.

The printer chassis 2 has a base panel 31 defining the printer bottom, right and left side panels 32 and 33 rising vertically from the base panel 31 with a specific gap therebetween, and a head mounting panel 34 disposed across the gap between the top portions of the side panels 32 and 33. The thermal print head 16 is mounted to the bottom of the head mounting panel 34. Pivot plates 35, 36 are oriented vertically to the printer chassis 2 and are disposed to the outside of the right and left side panels 32 and 33. The bottom end portions of the pivot plates 35, 36 are supported on support pins 37 and 38 (only support pin 37 is shown in the figures) at the front bottom end portion of the side panels 32, 33 so that the pivot plates 35, 36 can pivot in the longitudinal (front to back) direction of the printer chassis 2.

Pivot plate 35 has an inclined portion 35*a* extending at a slope upward and toward the back from the support pin 37, and a vertical portion 35*b* extending substantially vertically from the upper end of the inclined portion 35*a*. Two oblong holes 35*c* and 35*d* are formed at two vertically separated positions in the vertical portion 35*b*. Guide pins 39 and 40 affixed to the side panel 32 are inserted in these oblong holes 35*c* and 35*d* so that the pins can slide, thus limiting the pivot range of the pivot plate 35 in the longitudinal direction. The other pivot plate 36 is comprised in the same way and further description thereof is thus omitted.

The top ends of the right and left pivot plates 35, 36 are positioned above the head mounting panel 34, and a rectangular fixed blade mounting plate 41 is disposed horizontally widthwise to the printer between the pivot plates 35, 36. Oblong guide holes 41*a* and 41*b* extending longitudinally to the printer are formed in the fixed blade mounting plate 41 at both sides widthwise to the printer. The fixed blade mounting plate 41 also has a tab projecting to the back of the printer from the right rear side portion of the fixed blade mounting plate 41, and another oblong guide hole 41*c* is formed in this tab. Guide pins (not shown in the figure) are formed on the underside of the case top 6*a* of the printer case 6 that is attached to the printer chassis 2, and these guide pins are inserted from above into these guide holes 41*a* to 41*c*. These guide pins limit longitudinal movement of the fixed blade mounting plate 41.

Except for the portion where guide hole 41*c* is formed, the back edge portion of the fixed blade mounting plate 41 is bent perpendicularly downward to form bent portion 41*d*. A fixed blade pressure spring 42 is disposed in the compressed state between this bent portion 41*d* and a spring catch 33*a* formed at the top of the side panel 33 at the back side of the printer opposite the left side of the bent portion 41*d* (the opposite side from the guide hole 41*c*). The fixed blade mounting plate 41 disposed between the right and left pivot plates 35, 36 is thus constantly urged forward (toward the movable blade 22) with a predetermined spring force by the fixed blade pressure spring 42. A fixed blade 21 is fixed to the front underside edge portion of the fixed blade mounting plate 41 widthwise to the printer with the cutting edge 21*a* horizontal and facing forward.

The operable cover unit 3 attached at the front of the printer chassis 2 comprises a front panel portion 51 extending widthwise to the printer, and narrow side panel portions 52 and 53 formed by bending the right and left edges of the front panel portion 51 perpendicularly toward the back of the printer. The front of the front panel portion 51 slopes slightly from the bottom to the top towards the back of the printer. The movable blade 22 of the paper cutting device 20 is disposed here with the cutting edge 22*a* widthwise to the printer and facing up. A support stud 54 is affixed at the top right corner of the front panel portion 51 (on the same side as side panel portion 52), and the movable blade 22 can pivot vertically on this support stud 59 along the front of the front panel portion 51. The end portion 22*b* of the cutting edge 22*a* of the movable blade 22 on the side where cutting starts is disposed in front of and in contact with the end portion 21*b* of the cutting edge 21*a* of the fixed blade 21 on the same side.

The movable blade drive mechanism 23 for causing the movable blade 22 to pivot vertically comprises a drive motor 24 attached to the front panel portion 51, a worm 26 that is driven by the drive motor 24 through intervening speed reducing gear train 25, and a worm wheel 27 meshing with the worm 26. A drive pin 28 is affixed to the worm wheel 27, and this drive pin 28 is inserted slidably to a long narrow guide pin hole 29 formed in the movable blade 22.

Starting from the positions shown in FIG. 9A to FIG. 9C, when the drive motor 24 turns causing the worm wheel 27 to rotate in the direction indicated by arrow 27*a*, the movable blade 22 linked by intervening drive pin 28 moves circularly upward pivoting on the support stud 54 at the right end of the movable blade 22. The cutting edge 22*a* of the movable blade 22 is positioned with the end portion 22*b* where cutting starts in contact with the cutting edge 21*a* of the fixed blade 21. As a result, as the movable blade 22 pivots upward, the point of contact between the cutting edge 22*a* of the movable blade and the cutting edge 21*a* of the fixed blade moves from the end where paper cutting starts to the end where paper cutting ends.

The cutting edge 21*a* of the fixed blade 21 is inclined so that it projects slightly toward the front of the printer (towards the movable blade 22) from the end where paper cutting starts to the end where paper cutting ends. The cutting edge 22*a* of the movable blade 22 faces upward and extends widthwise to the printer. As a result, the cutting edge 22*a* of the movable blade 22 pushes the fixed blade 21 slightly toward the back of the printer as the movable blade 22 pivots. This applies a force suitable for cutting to the point of contact between the two blades. The entire fixed blade 21 can move along a curved path in the front-to-back direction of the printer by means of the fixed blade mounting plate 41 disposed between the right and left pivot plates 35, 36 pivoting on the support pins 37 and 38, and is constantly urged to the front of the printer by the fixed blade pressure spring 42. The cutting edges 21*a* and 22*a* therefore always contact at a point, and as the movable blade 22 pivots this contact point moves from the end where paper cutting starts to the end where paper cutting ends. As the point of contact between these cutting edges 21*a* and 22*a* thus moves, the portion of the recording paper 10*a* at this contact position is cut widthwise to the printer.

The fixed blade pressure spring 42 in this embodiment of the invention urges the fixed blade 21 at a position offset to the outside from the end of the cutting edge 21*a* of the fixed blade 21 where paper cutting ends. Forces denoted by arrows F1 and F2 in FIG. 5A and FIG. 6A act on the fixed blade 21. F1 is the pushing force of the movable blade 22, and F2 is the urging force of the fixed blade pressure spring 42. If the urging position of the fixed blade 21 (the position of F2) is located between the end where paper cutting starts and the end where paper cutting ends instead of outside the cutting range as in this embodiment of the invention, the direction of the angular moment of forces F1 and F2 acting on the fixed blade 21 reverses before and after the urging position as the point of contact moves along the cutting edges 21*a* and 22*a*, and the fixed blade 21 may shift in the front-to-back direction around this urging position or the point of contact between the blades. If the fixed blade 21 thus shifts while cutting the paper, problems such as the paper not being cut in a clean straight line may occur. Change in the force of contact between the blades may also prevent cutting the paper properly. This embodiment of the invention prevents such problems by rendering the urging position outside the cutting range.

This embodiment of the invention also comprises a fixed blade retraction mechanism for retracting the fixed blade 21 toward the back of the printer in resistance to the urging force in conjunction with opening the operable cover unit 3. The fixed blade retraction mechanism according to this embodiment of the invention is described with reference to FIG. 7A and FIG. 7B.

Figure 7B:
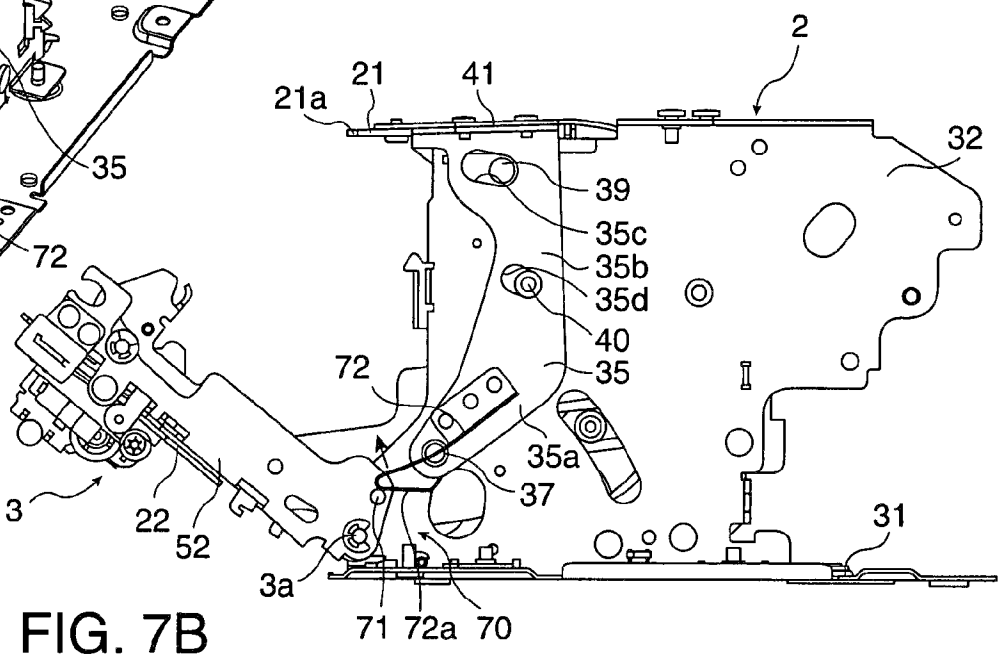
FIG. 7B is a side view of the fixed blade retraction mechanism of the printer.
Figure 7A:
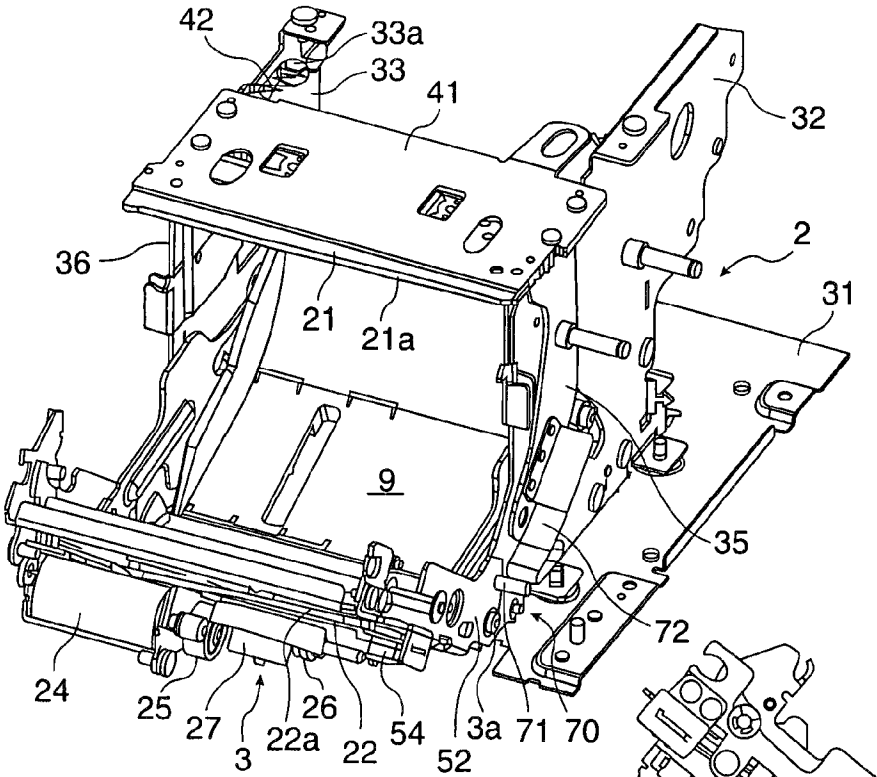
FIG. 7A is an oblique view of the fixed blade retraction mechanism of the printer.

FIG. 7A is an oblique view when the operable cover unit 3 is open, and FIG. 7B is a side view of the same. The fixed blade retraction mechanism 70 according to this embodiment of the invention comprises an engaging pin 71 affixed to the bottom end portion of the side panel portion 52 on the right side of the operable cover unit 3, and an engaging spring 72 disposed to the bottom end portion of the right side pivot plate 35 supporting the fixed blade 21.

The engaging pin 71 projects horizontally widthwise to the printer at a position offset slightly to the back of the printer from the pivot point 3*a* of the side panel portion 52. The engaging spring 72 slopes from the bottom end portion of the pivot plate 35 toward the bottom and front of the printer, and the bottom end portion of the engaging spring 72 is bent back toward the back of the printer, forming a bent portion 72*a* that is pushed from below by the engaging pin 71. The engaging pin 71 contacts the bent portion 72*a* at a position towards the front of the printer from the support pin 37 of the pivot plate 35.

When the operable cover unit 3 opens from the closed position shown in FIG. 4A to FIG. 4C, the engaging pin 71 moves circularly upward around pivot point 3*a*, thus pushing up on while sliding along the bottom part of the bent portion 72*a* of the engaging spring 72 as shown in FIG. 7A and FIG. 7B. As a result, the pivot plate 35 is forcibly pivoted downward around support pin 37, and the fixed blade 21 supported by the fixed blade mounting plate 91 at the top of the pivot plate 35 retracts and moves away from the paper exit 5.

When the operable cover unit 3 is completely open as shown in FIG. 7A and FIG. 7B, the cutting edge 21*a* of the fixed blade 21 is at a position retracted sufficiently from the front edge portion (near front edge 6*b*) of the case top 6*a* of the printer case 6 defining the paper exit 5. Accidents such as the operator cutting his finger on the cutting edge 21*a* of the fixed blade 21 when replacing the roll paper 10 with the operable cover unit 3 open can therefore be prevented.

The fixed blade 21 is disposed substantially horizontally on the printer chassis 2 side while the movable blade 22 is disposed substantially vertically on the operable cover unit 3 side in this thermal printer 1. That is the movable blade and fixed blade are positioned in planes substantially perpendicular to each other. Only enough space to render the fixed blade 21 horizontally is therefore needed at the top of the printer chassis 2 where the printer chassis 2 is installed. Compared with an arrangement in which the fixed blade 21 and movable blade 22 are opposed vertically to the printer, this invention minimizes the increase in printer height required to provide a paper cutting device, and therefore affords a short, compact thermal printer 1.

This thermal printer 1 can alternatively be rendered with the movable blade 22 disposed substantially horizontally on the printer chassis 2 side, the movable blade drive mechanism 23 also disposed on the printer chassis 2 side, and the fixed blade 21 disposed substantially vertically on the operable cover unit 3 side.

Furthermore, because the cutting edges 21*a* and 22*a* contact substantially perpendicularly, the fixed blade 21 and movable blade 22 can be formed with no curvature and disposed so that the cutting edges contact at a suitable contact angle. This simplifies knife manufacture, and therefore enables reducing the production cost and improving manufacturing quality.

Furthermore, because the fixed blade 21 and movable blade 22 contact substantially perpendicularly instead of contacting with the cutting edges 21*a* and 22*a* overlapping in the blade thickness direction, the operable cover unit 3 is not rendered unopenable as a result of the fixed blade 21 and movable blade 22 crossing with one on top of the other when the movable blade 22 stops in the middle of cutting the recording paper 10*a*, for example.

Yet further, because the fixed blade 21 affixed to the printer chassis 2 retracts in conjunction with opening the operable cover unit 3, accidents such as the operator's finger being cut by the cutting edge 21*a* of the fixed blade 21 when the operable cover unit 3 is open can be prevented.

The invention has been described using a thermal printer by way of example, but the invention can obviously be applied to other types of printers, including inkjet printers and dot impact printers.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer having a paper cutting device, and comprising:

a printer chassis;

a cover unit attached to the printer chassis so as to be movable between an open and a closed position;

a flat fixed blade affixed on the printer chassis and having a main surface that defines a first plane;

a flat movable blade disposed on the cover unit and having a main surface that defines a second plane, wherein the flat fixed blade and the flat movable blade are arranged to contact each other at a contact point;

a blade drive mechanism disposed on the cover unit for moving the flat movable blade such that the contact point moves along a cutting edge of the flat fixed blade and a cutting edge of the flat movable blade while the main surface of the flat movable blade is maintained within the second plane;

wherein the cover unit is arranged to pivot on a bottom end portion thereof between the closed position and the open position where the cover unit is tilted away from the printer chassis by a predetermined angle;

the flat movable blade is disposed substantially vertically extending widthwise to the printer at a top portion of the cover unit with the cutting edge of the flat movable blade facing up;

the flat fixed blade is disposed substantially horizontally extending widthwise to the printer at a top end portion on the printer chassis opposite the top end portion of the cover unit.

2. The printer of claim 1, wherein the blade drive mechanism is adapted to move the flat movable blade between a first position and a second position, wherein, in the first position, the contact point defines a cutting start point on the flat movable blade and the flat fixed blade and, in the second position, the contact point defines a cutting end point on the flat movable blade and the flat fixed blade, the flat movable blade being pivotally supported at an end portion of the flat movable blade.

3. The printer of claim 2, wherein the flat fixed blade is arranged to be movable substantially perpendicularly to the plane of the flat movable blade, and is urged by an urging member toward the flat movable blade.

4. The printer of claim 3, wherein the cutting start point and the cutting end point define a cutting range and wherein an urging force exerted by the urging member is applied to the flat fixed blade at a position outside the cutting range and closer to the cutting end point than the cutting start point.

5. The printer of claim 1, wherein the flat fixed blade is arranged to be movable in a front-to-back direction of the printer relative to the flat movable blade.

6. The printer of claim 1, further comprising a blade retraction mechanism linked to the cover unit for retracting the flat fixed blade in a direction away from the movable blade in resistance to an urging force of an urging member when the cover unit moves from its closed to its open position.

7. The printer of claim 1, further comprising:

a blade mounting plate to which the flat fixed blade is attached; and a pivot plate for supporting the blade mounting plate;

wherein the pivot plate is attached to the printer chassis to be pivotal in a front-to-back direction of the printer around a bottom end portion of the pivot plate;

the blade mounting plate is attached at a top portion of pivot plate;

the urging member urges the blade mounting plate; and the blade retraction mechanism comprises an engaging portion affixed to the cover unit, and an engaged portion attached to the pivot plate, wherein opening the cover unit causes the engaging portion to push the engaged portion, thus causing the pivot plate to pivot so that the blade mounting plate moves in a direction to separate the fixed blade from the movable blade.

8. A printer having a paper cutting device, and comprising:

a printer chassis;

a cover unit attached to the printer chassis to be movable between an open and a closed position;

a fixed blade affixed on the printer chassis;

a movable blade disposed on the cover unit, wherein the fixed blade and the movable blade are arranged to contact each other at a contact point;

a blade retraction mechanism linked to the cover unit for retracting the fixed blade in a direction away from the movable blade;

the blade retraction mechanism comprising an engaging portion affixed to the cover unit, and an engaged portion attached to the pivot plate;

wherein opening the cover unit causes the engaging portion to push the engaged portion, thus causing the pivot plate to pivot so that the blade mounting plate moves in a direction to separate the fixed blade from the movable blade.

* * * * *